US009677309B2

(12) United States Patent
Zhou et al.

(10) Patent No.: US 9,677,309 B2
(45) Date of Patent: Jun. 13, 2017

(54) SUPPORTING MECHANISM AND SORTING MACHINE PROVIDED WITH MECHANISM

(71) Applicant: GRG Banking Equipment Co., Ltd., Guangzhou, Guangdong (CN)

(72) Inventors: Guihong Zhou, Guangdong (CN); Wenjun Liao, Guangdong (CN); Zhan Liu, Guangdong (CN); Hexiang Huang, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/917,255

(22) PCT Filed: Jan. 29, 2014

(86) PCT No.: PCT/CN2014/071732
§ 371 (c)(1),
(2) Date: Mar. 7, 2016

(87) PCT Pub. No.: WO2015/035747
PCT Pub. Date: Mar. 19, 2015

(65) Prior Publication Data

US 2016/0215542 A1 Jul. 28, 2016

(30) Foreign Application Priority Data

Sep. 11, 2013 (CN) ..... 2013 1 0413809

(51) Int. Cl.
*E05D 7/00* (2006.01)
*G07D 11/00* (2006.01)
(Continued)

(52) U.S. Cl.
CPC ..... *E05D 7/00* (2013.01); *E05C 17/08* (2013.01); *E05D 11/1014* (2013.01);
(Continued)

(58) Field of Classification Search
CPC ..... E05D 7/00; E05D 3/18; E05D 11/1014; E05D 11/06; G07D 11/0003; G07D 11/00;
(Continued)

(56) References Cited

U.S. PATENT DOCUMENTS 1,352,602 A 9/1920 Herzog
1,362,255 A * 12/1920 Lund ..... A45C 13/34 16/332
(Continued)

FOREIGN PATENT DOCUMENTS

CH 373278 A 11/1963
CN 1395894 A 2/2003
(Continued)

OTHER PUBLICATIONS

Written Opinion, dated Apr. 15, 2014, from corresponding International National Application PCT/CN2014/071732.
(Continued)

*Primary Examiner* — William Miller
(74) *Attorney, Agent, or Firm* — Wolf, Greenfield & Sacks, P.C.

(57) ABSTRACT

A supporting mechanism and a sorting machine having the same are provided. The supporting mechanism includes a supporting body. An annular sliding slot is formed on a section of surface of the supporting body. A U-shaped clamping slot is provided in a ring of the annular sliding slot. A one-way deflecting locating valve plate is provided at the position of an opening of the U-shaped clamping slot and configured to close the annular sliding slot, and the locating valve plate is provided with a reset force configured to ensure a tendency of the locating valve plate to close the annular sliding slot. A deflecting angle of the locating valve plate ensures that a free end of the locating valve plate
(Continued)

deflects from one side to another side of the opening of the U-shaped clamping slot. The supporting mechanism has a simple operation and a high efficiency.

8 Claims, 4 Drawing Sheets

(51) Int. Cl.
*E05D 11/10* (2006.01)
*E05C 17/08* (2006.01)

(52) U.S. Cl.
CPC ..... *G07D 11/00* (2013.01); *G07D 11/0003* (2013.01); *Y10T 16/61* (2015.01)

(58) Field of Classification Search
CPC ..... G07D 13/00; Y10T 16/61; Y10T 16/5385; Y10T 16/5406; Y10T 16/544; E05C 17/20; E05C 17/24; E05C 17/08; G07F 19/20
USPC ..... 16/82, 297, 348, 357; 232/1 D; 902/8
See application file for complete search history.

(56) References Cited

U.S. PATENT DOCUMENTS

| | | | | |
|---|---|---|---|---|
| 1,367,681 | A * | 2/1921 | Ambruster | E05C 17/085 16/348 |
| 1,707,511 | A | 4/1929 | Cornwell | |
| 1,776,198 | A * | 9/1930 | Russ | A45C 13/34 16/348 |
| 1,796,331 | A * | 3/1931 | Jackson | E05C 17/085 16/348 |
| 2,076,860 | A | 4/1937 | North | |
| 2,233,882 | A * | 3/1941 | Bobek | E05C 17/38 16/348 |
| 5,414,898 | A * | 5/1995 | Gastaldi | A45C 13/34 16/345 |
| 9,004,212 | B2 * | 4/2015 | Noda | B66C 13/52 16/348 |
| 2003/0009917 | A1 | 1/2003 | Voswinked | |
| 2009/0140114 | A1 | 6/2009 | Blackburn | |

FOREIGN PATENT DOCUMENTS

| | | | |
|---|---|---|---|
| CN | 2683266 | Y | 3/2005 |
| CN | 1885354 | A | 12/2006 |
| CN | 1932890 | A | 3/2007 |
| CN | 201097754 | Y | 8/2008 |
| CN | 202834610 | U | 3/2013 |
| CN | 103440705 | | 12/2013 |
| CN | 203433578 | U | 2/2014 |
| FR | 2764930 | A1 | 12/1998 |
| JP | 2010149671 | A | 7/2010 |
| TW | M369945 | U1 | 12/2009 |

OTHER PUBLICATIONS

International Search Report, dated Apr. 15, 2014, from corresponding International Application No. PCT/CN2014/071732.
Extended European Search Report, dated Oct. 19, 2016, from related European Application No. 14843398.0.

* cited by examiner

SUPPORTING MECHANISM AND SORTING MACHINE PROVIDED WITH MECHANISM

This application is the national phase of International Application No. PCT/CN2014/071732, titled "SUPPORTING MECHANISM AND SORTING MACHINE PROVIDED WITH MECHANISM", filed on Jan. 29, 2014, which claims priority to Chinese patent application No. 201310413809.2, titled "SUPPORTING MECHANISM AND SORTING MACHINE HAVING THE SAME", filed with the Chinese State Intellectual Property Office on Sep. 11, 2013, each of which applications are incorporated herein by reference to the maximum extent allowable by law.

FIELD

The present application relates to a supporting mechanism, and particularly to a supporting mechanism for limiting a position between two pivotally connected components in opened state.

BACKGROUND

In our real life, items or devices with hinged components are used all around. Two hinged components in these items or devices usually need to be opened. To keep the two hinged components in an opened state for a certain time after they are opened, a supporting mechanism is required to be provided between the two hinged components. For example, in a conventional financial self-service machine, paper currencies are required to be separated one by one and conveyed to a specified position in a long conveying passage, jam may occasionally occur when a single piece of paper currency is conveyed in the long conveying passage. Also, after the apparatus is used for a long time, the conveying passage needs to be cleaned, maintained and inspected. Therefore the conveying passage of the financial self-service machine is generally designed to include a first component and a second component which are pivotally connected and openable.

When the conveying passage is flipped, the first component 1 which is movable needs to be flipped. In order to maintain the flipped first component in the opened state, a supporting frame mechanism is employed to support the first component to facilitate inspection or maintenance of the second component. A conventional supporting mechanism is provided with a torsion spring disposed on a pivot shaft for hinging the first and second components, and a supporting member mounted between the first component and the second component. As shown in FIG. 1, this combined supporting mechanism is controlled by a spring 91 and a position-limiting supporting member 92 to be opened and closed. To open an upper cover 93, a cylindrical pin 94 of the upper cover 93 slides along a clamping slot of the supporting member 92. After the upper cover 93 is opened in place, the cylindrical pin 94 of the upper cover 93 is stuck in a groove of the supporting member 92, thus preventing the upper cover from falling back. To close the upper cover, the upper cover may be closed only when the supporting member is manually pulled open. Although this solution is safe and reliable, this solution has a cumbersome operation and a low efficiency.

Apparently, a gas spring may be mounted between the first component and the second component to realize a position-limiting supporting, however, the cost of the gas spring is high, which is not advantageous to cost control.

SUMMARY

In order to solve the problems of the conventional supporting mechanism, such as a cumbersome operation, a poor safety or a high cost, a position-limiting supporting mechanism is provided by the present application, which has a simple and convenient operation, a high efficiency, and a high reliability and safety.

This supporting mechanism for limiting a position between a first component and a second component pivotally connected in opened state has a supporting body. The supporting body has a rotary end. The rotary end is pivotally connected to the first component by a rotary shaft. An annular sliding slot is formed on a section of surface, away from the rotary end, of the supporting body. The annular sliding slot provides a route guidance for a locating pin disposed on the second component. A U-shaped clamping slot for hooking the above locating pin is provided in the annular sliding slot. A one-way deflecting locating valve plate is provided at the position of an opening of the U-shaped clamping slot in the annular sliding slot. The locating valve plate is mounted on the supporting body by a mounting rotary shaft and configured to close the annular sliding slot. The locating valve plate is provided with a reset force configured to ensure a tendency of the locating valve plate to close the annular sliding slot. A deflecting angle of the locating valve plate ensures that a free end of the locating valve plate deflects from one side of the opening of the U-shaped clamping slot to another side of the opening of the U-shaped clamping slot and the locating pin falls into the U-shaped clamping slot.

Preferably, a one-way deflecting guiding valve plate configured to close the annular sliding slot is provided in the annular sliding slot at an initial position of the locating pin. The initial position of the locating pin is at one side, to which the guiding valve plate is allowed to deflect, of the guiding valve plate. The guiding valve plate is arranged on the supporting body by a second mounting rotary shaft and configured to close the annular sliding slot. The guiding valve plate is provided with a reset force configured to ensure a tendency of the guiding valve plate to close the annular sliding slot, and a one-way deflection direction of the guiding valve plate is opposite to a one-way deflection direction of the locating valve plate.

Preferably, the locating valve plate is provided with the reset force by a torsion spring.

Further, the locating valve plate and the guiding valve plate are each provided with the reset force by a torsion spring.

Preferably, a torsion spring is provided between the supporting body and the first component, and the torsion spring provides a reset force for the supporting body.

A sorting machine is further provided according to the present application, which has an upper cover and a lower machine body pivotally connected. A supporting mechanism is mounted between the upper cover and the lower machine body. The supporting mechanism has a supporting body. The supporting body has a rotary end. The rotary end is pivotally connected to the lower machine body by a rotary shaft. An annular sliding slot is formed on a section of surface, away from the rotary end, of the supporting body. The annular sliding slot provides a route guidance for the locating pin disposed on the upper cover. A U-shaped clamping slot for hooking the above locating pin is provided in the annular sliding slot. A one-way deflecting locating valve plate is provided at the position of an opening of the U-shaped clamping slot in the annular sliding slot. The locating valve plate is arranged on the supporting body by a mounting rotary shaft and configured to close the annular sliding slot. The locating valve plate is provided with a reset force configured to ensure a tendency of the locating valve plate to close the annular sliding slot. A deflecting angle of the locating valve plate ensures that a free end of the locating valve plate deflects from one side of the opening of the U-shaped clamping slot to another side of the opening of the U-shaped clamping slot and the locating pin falls into the U-shaped clamping slot.

Preferably, a one-way deflecting guiding valve plate configured to close the annular sliding slot is provided in the annular sliding slot at an initial position of the locating pin. The initial position of the locating pin is at one side, to which the guiding valve plate is allowed to deflect, of the guiding valve plate. The guiding valve plate is arranged on the supporting body by a second mounting rotary shaft and configured to close the annular sliding slot. The guiding valve plate is provided with a reset force configured to ensure a tendency of the guiding valve plate to close the annular sliding slot, and a one-way deflection direction of the guiding valve plate is opposite to a one-way deflection direction of the locating valve plate.

Preferably, the locating valve plate is provided with a reset force by a torsion spring.

Further, the locating valve plate and the guiding valve plate are each provided with a reset force by a torsion spring.

Preferably, a torsion spring is provided between the supporting body and the lower machine body, and the torsion spring provides a reset force for the supporting body.

Compared with the conventional supporting mechanism, the supporting mechanism according to the present application has the following advantageous effects:

(1) operation is simple and efficiency is high: in the present solution, two pivotally connected components may be opened and closed easily only by a one-handed operation, which saves time and trouble.

(2) safety is high: during the opening process of the two components, the position-limiting valve can be reset only after the locating pin falls into the U-shaped clamping slot; and the supporting state of the opened component can be unlocked only by lifting up again the opened component to lift up the locating pin from the U-shaped clamping slot; thus during the whole process, the opened component can be effectively prevented from falling off undesirable to cause injury; and (3) the supporting mechanism in the present solution has a small, thus facilitates miniaturization of the overall device.

DETAILED DESCRIPTION

To further illustrate the supporting mechanism according to the present application, a further detailed description will be made hereinafter by taking a sorting machine employing this supporting mechanism as a preferred embodiment and in conjunction with drawings.

Figure 1:
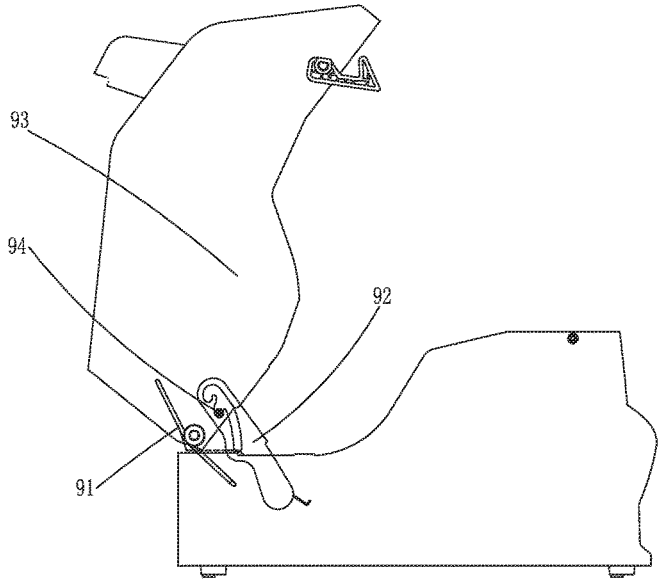
Fig. 1 Prior Art
FIG. 1 is a schematic view of a sorting machine having a conventional supporting mechanism.
Figure 2:
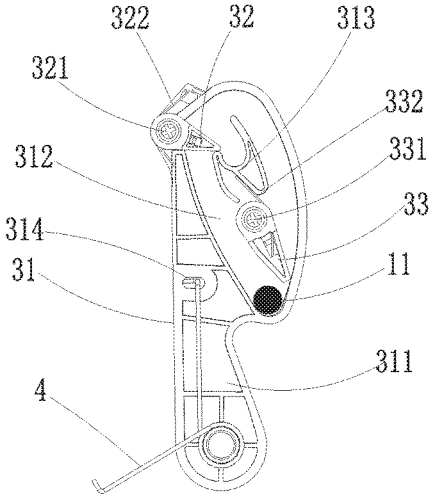
FIG. 2 is a schematic perspective view of a new supporting mechanism provided according to the present application.
Figure 3:
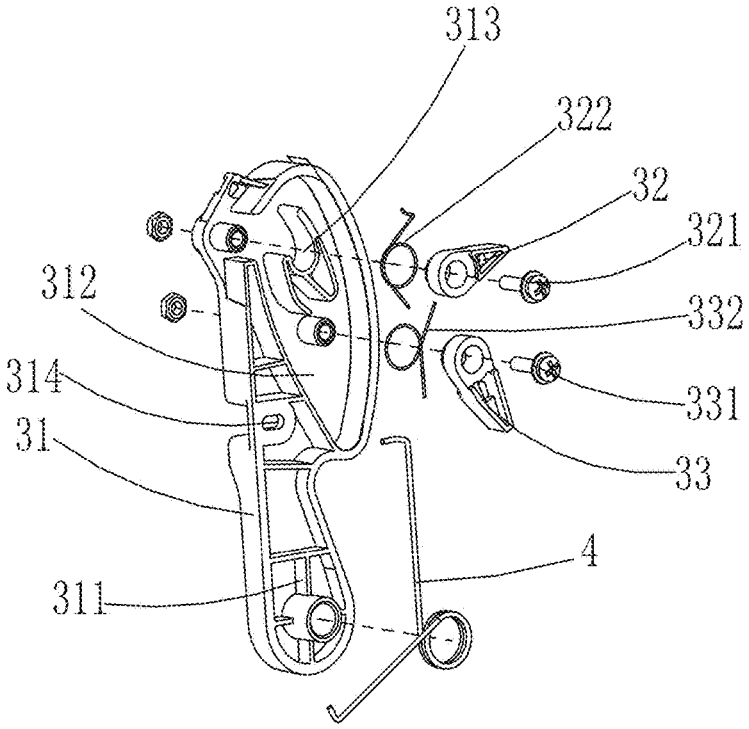
FIG. 3 is a schematic exploded view of the supporting mechanism shown in FIG. 2.
Figure 4:
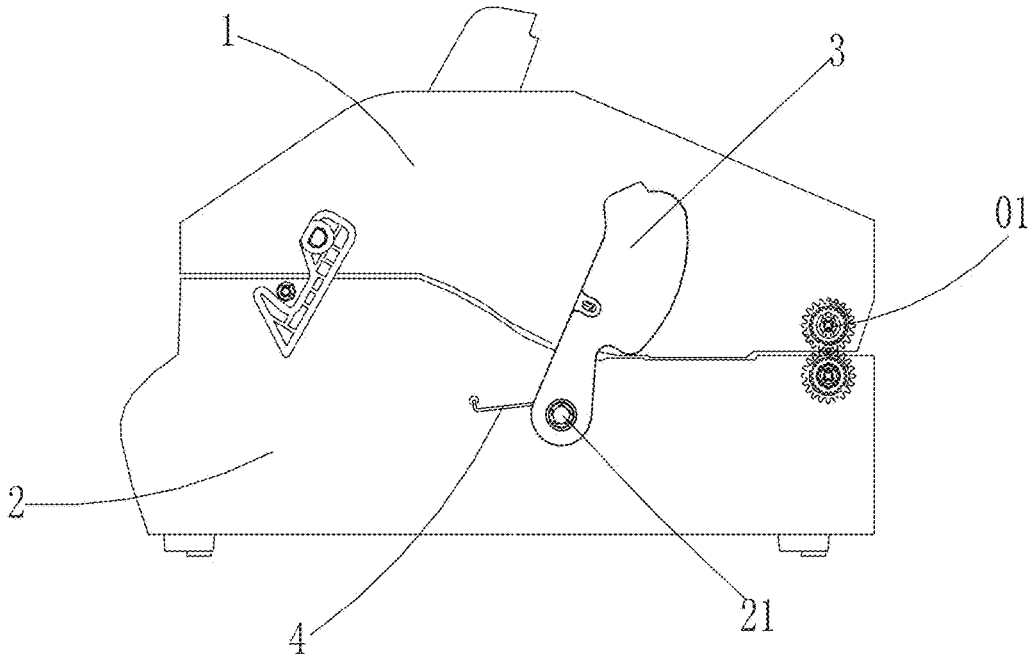
FIG. 4 is a schematic view of the supporting mechanism shown in FIG. 2 being used in a sorting machine.

Referring to FIGS. 2, 3 and 4, a sorting machine includes an upper cover 1 and a lower machine body 2 which are pivotally connected by a rotary shaft 01. A supporting mechanism 3 is mounted between the upper cover 1 and the lower machine body 2. The supporting mechanism 3 has a supporting body 31, and the supporting body 31 is provided with a rotary end 311 which is pivotally connected to the lower machine body 2 by a rotary shaft 21. An annular sliding slot 312 is formed on a section of surface, away from the rotary end 311, of the supporting body 31. The annular sliding slot 312 provides a route guidance for a locating pin 11 disposed on the upper cover 1. In the ring of the annular sliding slot 312, a U-shaped clamping slot 313 for hooking the above mentioned locating pin 11 is provided. A one-way deflecting locating valve plate 32 is provided in the annular sliding slot 312 at the position of an opening of the U-shaped clamping slot 313. The locating valve plate 32 is disposed on the supporting body 31 by a mounting rotary shaft 321 and configured to close the annular sliding slot 312. The locating valve plate 32 is provided with a reset force configured to ensure a tendency of the locating valve plate 32 to close the annular sliding slot 312. In this embodiment, this reset force is provided by a torsion spring 322 mounted on the mounting rotary shaft 321. The torsion spring 322 has one end fixed to the supporting body 31, and another end fixed to the locating valve plate 32. The locating valve plate 32 has a deflecting angle configured to ensure that a free end of the locating valve plate 32 deflects from one side of the opening of the U-shaped clamping slot 313 to another side of the opening of the U-shaped clamping slot 313 and allow the locating pin 11 to fall into the U-shaped clamping slot 313. In order that the supporting mechanism 3 can be effectively reset during the opening and closing process of the upper cover 1, a torsion spring 4 is provided between the supporting body 31 and the lower machine body 2. The torsion spring 4 is sleeved on the rotary shaft 21. The torsion spring 4 has one end fixed to the lower machine body 2, and another end hooked to a racetrack-shaped hole 314. The torsion spring 4 provides a reset force for the supporting body 31.

Further, in order to ensure that the locating pin 11 may slide in the annular sliding slot 312 along a predetermined route during the opening process of the upper cover 1, a one-way deflecting guiding valve plate 33 configured to close the annular sliding slot 312 is provided in the annular sliding slot 312 at an initial position of the locating pin 11*c*. The initial position of the locating pin 11 is at one side of the guiding valve plate 33 to which the guiding valve plate 33 is allowed to deflect. The guiding valve plate 33 is disposed on the supporting body 31 by a second mounting rotary shaft 331 and configured to close the annular sliding slot 312. The guiding valve plate 33 is provided with a reset force configured to ensure a tendency of the guiding valve plate 33 to close the annular sliding slot 312. In this embodiment, the reset force is provided by a torsion spring 332 sleeved on the mounting rotary shaft 331. The torsion spring 332 has one end fixed to the supporting body 31 and another end fixed to the guiding valve plate 32. A one-way deflection direction of the guiding valve plate 33 is opposite to that of the locating valve plate 32. In this embodiment, the locating valve plate 32 can only deflect counterclockwise, and the guiding valve plate 33 can only deflect clockwise.

Figure 5:
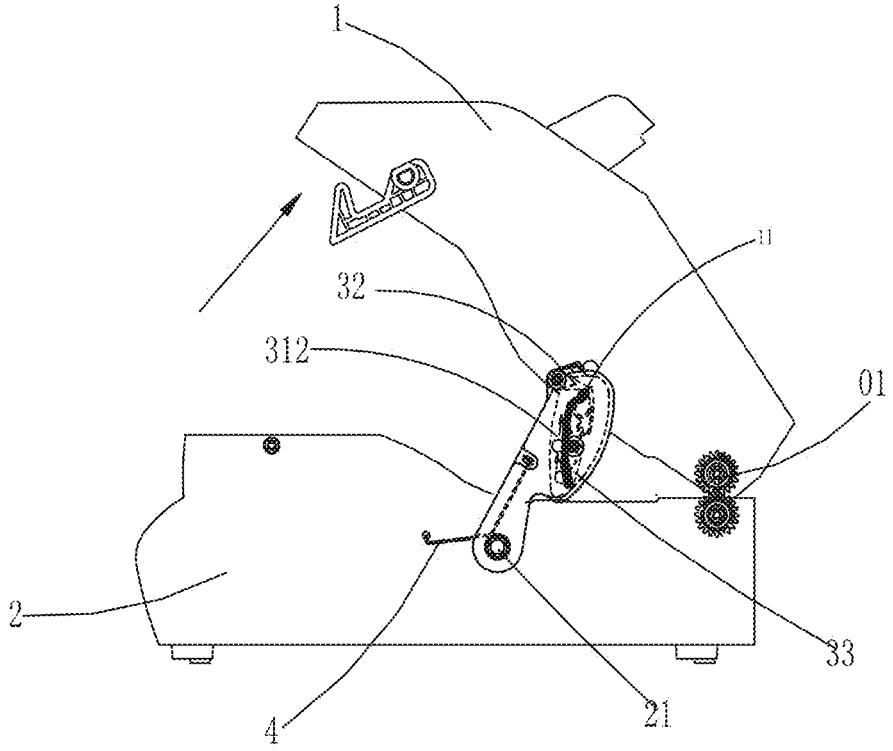
FIG. 5 is a schematic view showing the operation of the supporting mechanism in an opening process of an upper cover of the sorting machine.
Figure 6:
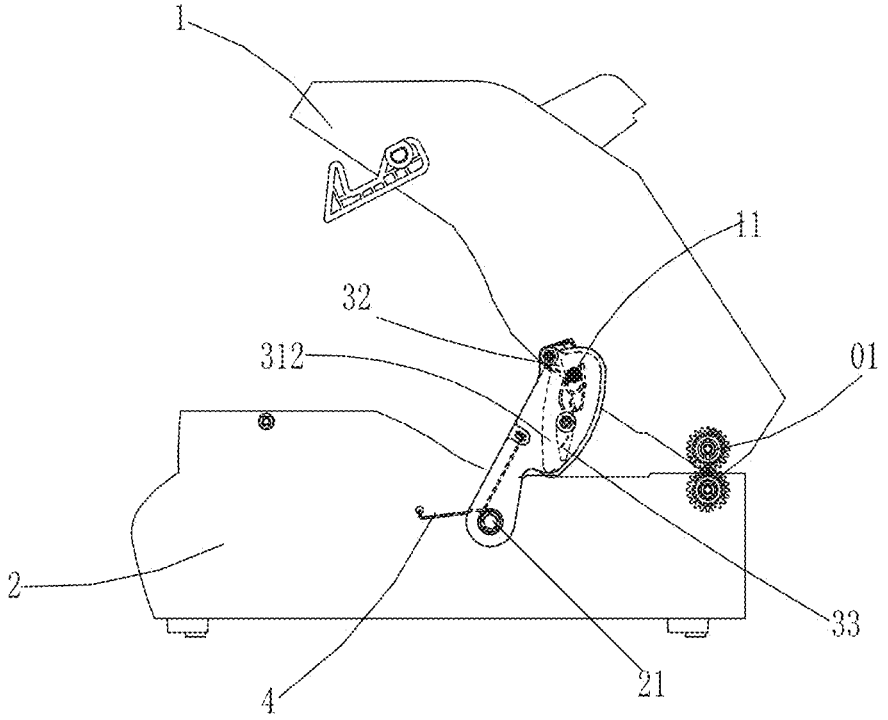
FIG. 6 is a schematic view of the supporting mechanism in locked state after the upper cover of the sorting machine is opened.
Figure 7:
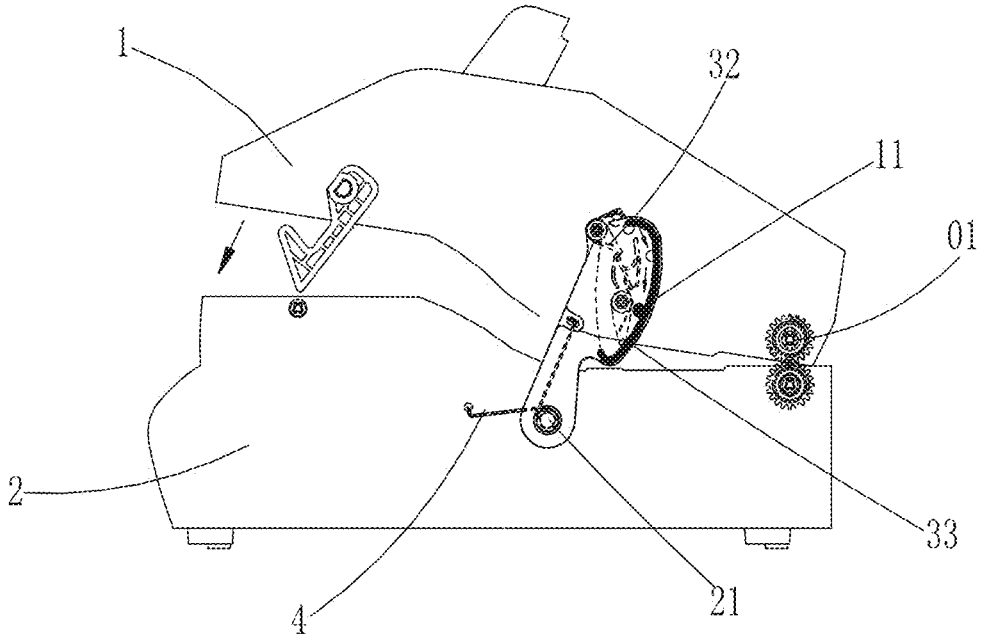
FIG. 7 is a schematic view showing the operation of the supporting mechanism in a closing process of the upper cover of the sorting machine.

As shown in FIGS. 4 to 7, which are respectively schematic views showing the supporting mechanism 3 at a plurality of critical positions during the opening and closing process of the upper cover 1 of the sorting machine, and during the opening process of the upper cover 1, the locating pin 11 slides along a locus shown by arrows in FIG. 5 under the guiding of the guiding valve plate 33 which can only deflect clockwise. When the locating pin 11 slides to the position of the locating valve plate 32, the locating valve plate 32 is pushed by the locating pin 11 to deflect counterclockwise. When the locating pin 11 reaches the position of the opening of the U-shaped clamping slot 313, the locating valve plate 32 does not deflect counterclockwise any more. At this time, if an acting force for opening the upper cover is removed, the locating pin 11 automatically falls into the U-shaped clamping slot 313, thus achieving a position-limiting function in the opened state of the upper cover. At this time, the locating valve plate 32 is reset under the action of the reset spring 322 since the locating valve plate 32 is not pushed by the locating pin 11, as shown in FIG. 6.

In the case that the upper cover is required to be closed, the upper cover 1 is slightly lifted up in order to lift the locating pin 11 up from the U-shaped clamping slot 313. At this time, the locating pin 11 can only slide along a locus shown in FIG. 7 since the annular sliding slot 312 is closed by the locating valve plate 32. When the locating pin 11 slides to the guiding valve plate 33 configured to close the annular sliding slot 312, the guiding valve plate 33 is pushed by the locating pin 11 to deflect clockwise until the locating pin 11 completely passes a free end of the guiding valve plate to return to the initial position thereof, thus completing the entire closing operation of the upper cover. At this time, the guiding valve plate is also automatically reset under the action of the reset force.

The embodiments described hereinabove are only preferred embodiments of the present application. It should be noted that, the above preferred embodiments should not be interpreted as a limitation to the present application, and the protection scope of the present application is defined by the claims of the present application. For those skilled in the art, many improvements and modifications may be made to the present application without departing from the principle of the present application, and these improvements and modifications are also deemed to fall into the protection scope of the present application.

What is claimed is:

1. A supporting mechanism, configured to limit a position between a first component and a second component pivotally connected in an opening process, and comprising a supporting body, wherein the supporting body comprises a rotary end, and the rotary end is pivotally connected to the first component by a rotary shaft;

an annular sliding slot is formed on a section of surface, away from the rotary end, of the supporting body, the annular sliding slot provides a route guidance for a locating pin arranged on the second component, and a U-shaped clamping slot for hooking the locating pin is provided in a ring of the annular sliding slot;

a one-way deflecting locating valve plate is provided at the position of an opening of the U-shaped clamping slot in the annular sliding slot, the locating valve plate is arranged on the supporting body by a mounting rotary shaft and configured to close the annular sliding slot, and the locating valve plate is provided with a reset force configured to ensure a tendency of the locating valve plate to close the annular sliding slot; and a deflecting angle of the locating valve plate ensures that a free end of the locating valve plate deflects from one side of the opening of the U-shaped clamping slot to another side of the opening of the U-shaped clamping slot, and the locating pin falls into the U-shaped clamping slot; wherein a one-way deflecting guiding valve plate configured to close the annular sliding slot is provided in the annular sliding slot at an initial position of the locating pin, and the initial position of the locating pin is at one side of the guiding valve plate, to which side the guiding valve plate is allowed to deflect, the guiding valve plate is arranged on the supporting body by a second mounting rotary shaft and configured to close the annular sliding slot, the guiding valve plate is provided with a reset force configured to ensure a tendency of the guiding valve plate to close the annular sliding slot, and a one-way deflection direction of the guiding valve plate is opposite to a one-way deflection direction of the locating valve plate.

2. The supporting mechanism according to claim 1, wherein the locating valve plate is provided with the reset force by a first torsion spring.

3. The supporting mechanism according to claim 1, wherein the locating valve plate and the guiding valve plate are provided with the reset force by a first torsion spring and a second torsion spring, respectively.

4. The supporting mechanism according to claim 1, wherein a torsion spring is provided between the supporting body and the first component, and the torsion spring provides a reset force for the supporting body.

5. A sorting machine, comprising an upper cover and a lower machine body pivotally connected, a supporting mechanism being mounted between the upper cover and the lower machine body, wherein the supporting mechanism comprises a supporting body, the supporting body comprises a rotary end, and the rotary end is pivotally connected to the lower machine body by a rotary shaft;

an annular sliding slot is formed on a section of surface, away from the rotary end, of the supporting body, the annular sliding slot provides a route guidance for the locating pin arranged on the upper cover, and a U-shaped clamping slot for hooking the locating pin is provided in a ring of the annular sliding slot;

a one-way deflecting locating valve plate is provided at the position of an opening of the U-shaped clamping slot in the annular sliding slot, the locating valve plate is arranged on the supporting body by a mounting rotary shaft and configured to close the annular sliding slot, and the locating valve plate is provided with a reset force configured to ensure a tendency of the locating valve plate to close the annular sliding slot; and a deflecting angle of the locating valve plate ensures that a free end of the locating valve plate deflects from one side of opening of the U-shaped clamping slot to another side of the opening of the U-shaped clamping slot, and the locating pin falls into the U-shaped clamping slot; wherein a one-way deflecting guiding valve plate configured to close the annular sliding slot is provided in the annular sliding slot at an initial position of the locating pin, and the initial position of the locating pin is at one side of the guiding valve plate, to which side the guiding valve plate is allowed to deflect, the guiding valve plate is arranged on the supporting body by a second mounting rotary shaft and configured to close the annular sliding slot, the guiding valve plate is provided with a reset force configured to ensure a tendency of the guiding valve plate to close the annular sliding slot, and a one-way deflection direction of the guiding valve plate is opposite to a one-way deflection direction of the locating valve plate.

6. The sorting machine according to claim 5, wherein the locating valve plate is provided with the reset force by a first torsion spring.

7. The sorting machine according to claim 5, wherein the locating valve plate and the guiding valve plate are provided with the reset force by a first torsion spring and a second torsion spring respectively.

8. The sorting machine according to claim 5, wherein a torsion spring is provided between the supporting body and the lower machine body, and the torsion spring provides a reset force for the supporting body.

* * * * *